United States Patent [19]

Asakawa et al.

[11] 4,305,152

[45] Dec. 8, 1981

[54] SECURITY COMMUNICATION SYSTEM

[75] Inventors: Shigeru Asakawa, Fujisawa; Makoto Nakamura, Kanagawa; Fumio Sugiyama, Sagamihara; Tsukasa Okai, Yokohama, all of Japan

[73] Assignee: Tokyo Shibaura Denki Kabushiki Kaisha, Kawasaki, Japan

[21] Appl. No.: 23,957

[22] Filed: Mar. 26, 1979

[30] Foreign Application Priority Data

Mar. 31, 1978 [JP] Japan ..... 53/37744

[51] Int. Cl.[3] ..... H04K 1/00

[52] U.S. Cl. ..... 455/26; 178/22.17; 179/1.5 R; 375/2.1; 375/112

[58] Field of Search ..... 375/2, 112; 179/1.5 R; 178/22; 455/26

[56] References Cited

U.S. PATENT DOCUMENTS

| | | | |
|---|---|---|---|
| 2,950,348 | 8/1960 | Mayer et al. | 179/1.5 R |
| 3,124,652 | 3/1964 | Biagi et al. | 179/1.5 R |
| 3,723,878 | 3/1973 | Miller | 179/1.5 R |
| 4,052,565 | 10/1977 | Baxter et al. | 375/2 |
| 4,079,195 | 3/1978 | Frutiger | 179/1.5 R |
| 4,086,537 | 4/1978 | Asakawa et al. | 343/204 |
| 4,099,027 | 7/1978 | Whitten | 179/1.5 R |
| 4,100,374 | 7/1978 | Jayant et al. | 179/1.5 R |
| 4,179,586 | 12/1979 | Mathews, Jr. et al. | 179/1.5 R |

OTHER PUBLICATIONS

"An Experimental Pulse Code Modulation System for Short-Haul Trunks," Davis, *Bell System Tech, Journ,* Vol. XLI, 1962, p. 1–3.

*Primary Examiner*—Howard A. Birmiel
*Attorney, Agent, or Firm*—Oblon, Fisher, Spivak, McClelland & Maier

[57] ABSTRACT

A security communication system comprises a transmission apparatus including a scrambling circuit for scrambling an information signal according to a specific code and a reception apparatus including a deciphering circuit for deciphering an output signal of the transmission apparatus according to substantially the same code as the specific code. The transmission apparatus further includes a first signal generating circuit for supplying a synchronizing signal to the scrambling circuit to drive the same, a signal synthesizing circuit having a first input terminal coupled to the output terminal of the first signal generating circuit, and a switching circuit connected between the output terminal of the scrambling circuit and a second input terminal of the signal synthesizing circuit, said switching circuit being opened while the first signal generating circuit is generating a synchronizing signal. The reception apparatus further includes a second signal generating circuit and a synchronization circuit for supplying a drive signal to the deciphering circuit when the synchronizing signal component in the output signal of the transmission apparatus synchronizes with the output signal of the second signal generating circuit.

6 Claims, 25 Drawing Figures

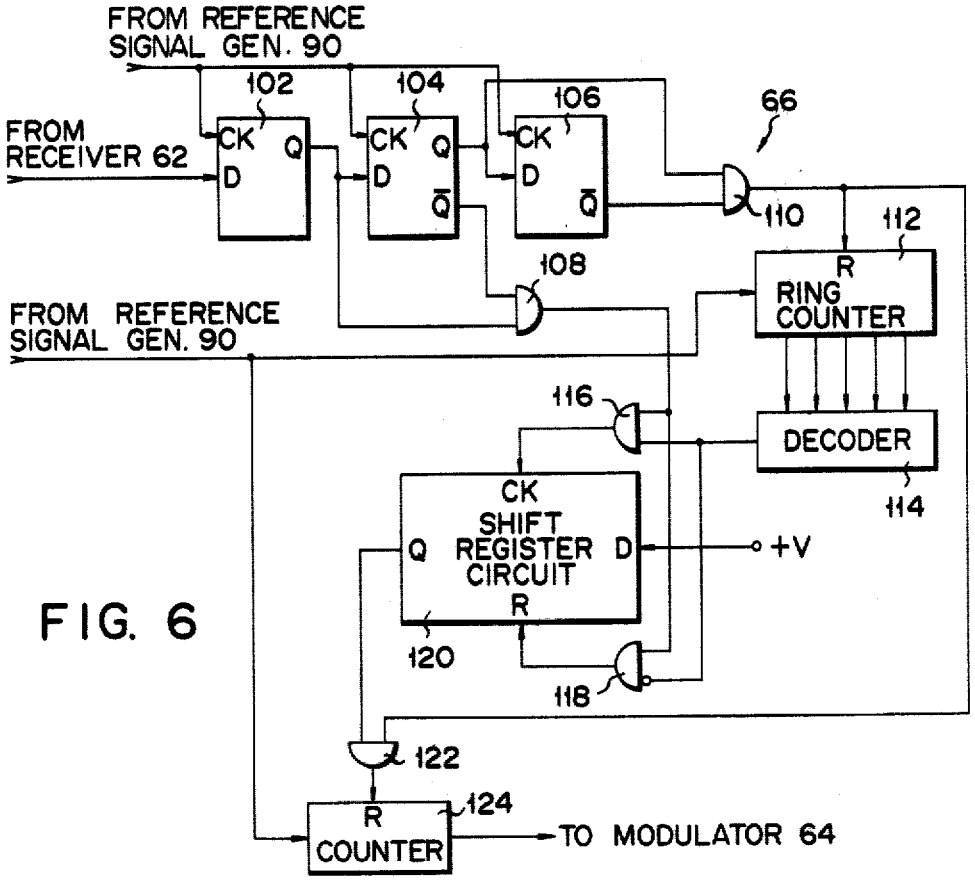
FIG. 6
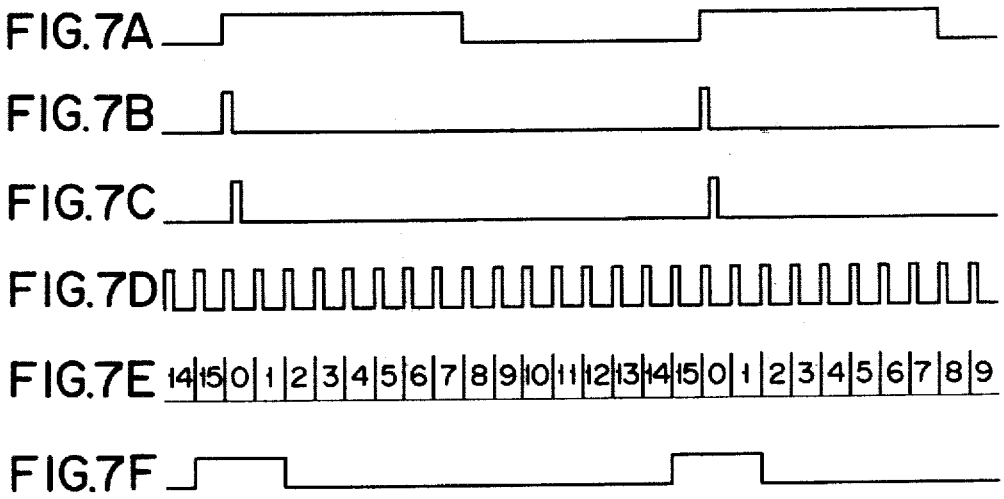

SECURITY COMMUNICATION SYSTEM

BACKGROUND OF THE INVENTION

This invention relates to a security communication system.

Generally it is desired that information should be exchanged exclusively between those who are authorized to do so. But it is relatively easy for the outsiders to monitor the information. To prevent such a leak of information, the information has been coded or encrypted and then transmitted, and the coded information has been deciphered at the receiving station. To decipher the coded information correctly, it is necessary to carry out the coding at the transmitting station and the deciphering at the receiving station in synchronism. Hitherto, a synchronizing signal has been transmitted to the receiving station via a channel other than the information transmission channel or via the information transmission channel as pilot signal. But it is uneconomical to transmit the synchronizing signal through another channel. If the pilot signal is transmitted through the information transmission channel, the frequency band allowed to the information signal will be so limited or the dynamic range of the information signal is so limited as to degrade S/N ratio or generate jitter in the synchronizing signals, thus making it impossible to achieve an accurate synchronization between the coding and decipherring.

The frequency band allowed for general radio communication is relatively broad, for example, ranging from 300 Hz to 3 KHz. Despite this, it has been difficult to transmit coded information signal without degradation since the signal component which can be coded by the conventional security communication system has a D.C. component or an extremely low frequency component.

SUMMARY OF THE INVENTION

It is an object of this invention to provide a security communication system in which a part of an information signal is replaced by a synchronizing signal thereby to accomplish a reliable security communication with a high efficiency.

A security communication system according to this invention comprises transmission means including a scrambling circuit for scrambling an information signal according to a specific code, a first signal generating circuit for supplying synchronizing signal to the scrambling circuit to control the timing of coding or encrypting in the scrambling circuit, and a signal synthesizing circuit for removing that part of an information signal which has been coded or encrypted and inserting the synchronizing signal into the coded information signal while the first signal generating circuit is generating a synchronizing signal; and reception means including a deciphering circuit for deciphering the output signal of the transmission means according to the specific code and a second signal generating circuit for detecting the synchronizing signal in the output signal of the transmission means to supply the deciphering circuit with an output signal which is synchronous with the detected synchronizing signal, thereby controlling the timing of deciphering in the deciphering circuit.

BRIEF DESCRIPTION OF THE DRAWINGS

FIG. 6 is a circuit diagram of the modulation synchronizing circuit used in the security communication system illustrated in FIG. 3;

FIGS. 7A–7F show signal waveforms for explaining the operation of the modulation synchronizing circuit illustrated in FIG. 6.

DETAILED DESCRIPTION OF THE PREFERRED EMBODIMENTS

Now referring to the accompanying drawings, security communication systems according to this invention will be described.

Figure 1:
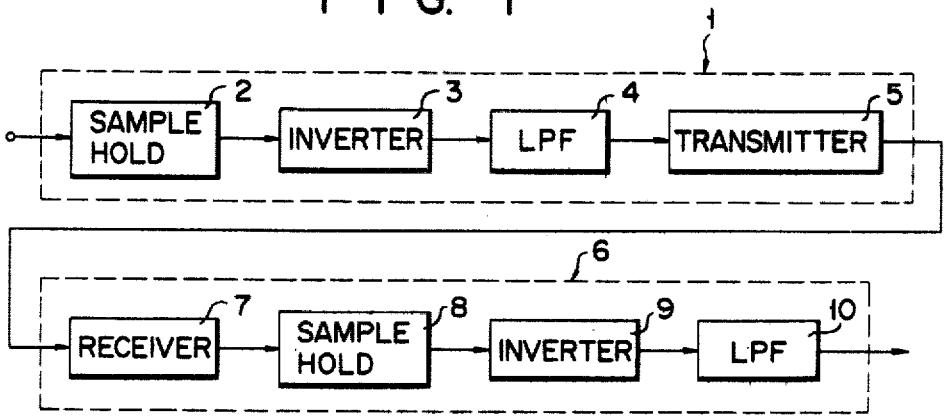
FIG. 1 is a block circuit diagram showing the basic construction of an security communication system according to this invention.

FIG. 1 shows the basic construction of a security communication system according to this invention. The system comprises a transmission apparatus 1 and a reception apparatus 6. The transmission apparatus 1 is provided with a sample/hold circuit 2 for sampling an input information, an inverter 3 for inverting an output signal of the sample/hold circuit 2 according to a specific code, a low-pass filter 4 and a transmitter 5 receiving the output signal of the inverter 3 via the low-pass filter 4. The reception apparatus 6 is provided with a receiver 7 receiving an output signal of the transmitter 5, a sample/hold circuit 8 for sampling an output signal of the receiver 7, an inverter 9 for inverting an output signal of the sample/hold circuit 8 according to the same code as the specific code and a low-pass filter 10 receiving an output signal of the inverter 9.

With reference to the signal waveforms illustrated in FIGS. 2A to 2E, it will now be described how the security communication system operates.

Figure 2A:
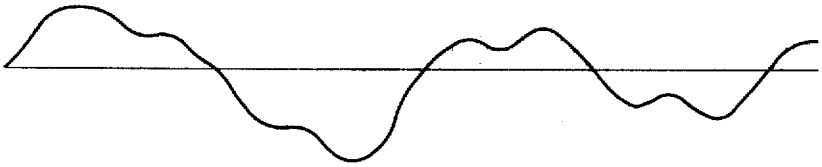
FIGS. 2A–2E show various signal waveforms for explaining the operation of the security communication system illustrated in FIG. 1.
Figure 2B:
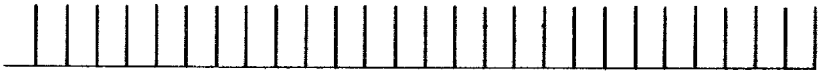
Figure 2C:
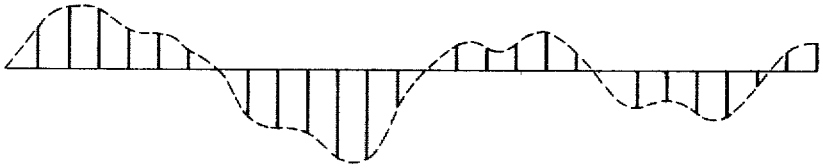
Figure 2D:
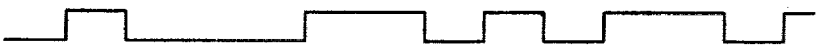
Figure 2E:
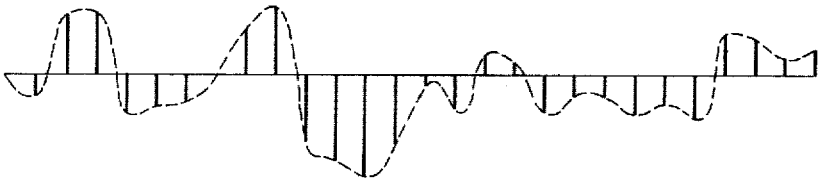

Such an information signal as shown in FIG. 2A is supplied to the sample/hold circuit 2 of the transmission apparatus 1. The sample/hold circuit 2 samples the input information signal, using such sampling pulses as shown in FIG. 2B, and then produces such an output signal as shown in FIG. 2C. The inverter 3 inverts the output signal of the sample/hold circuit 2 according to such a specific code as shown in FIG. 2D. More specifically, the inverter 3 inverts the input signal when the code has a low level and does not invert the input signal when the code has a high level, thereby producing such an output signal as shown in FIG. 2E. The output signal of the inverter 3 is supplied via the low-pass filter 4 to the transmitter 5 in such a form as indicated by the broken line in FIG. 2E. It is modulated by the transmitter 5 and then is transmitted to the reception apparatus 6.

The output signal of the transmission apparatus 1 is supplied to the receiver 7 of the reception apparatus 6. The receiver 7 demodulates the input signal and supplies the demodulated signal to the sample/hold circuit 8. The sample/hold circuit 8 samples the output signal of the receiver 7 to generate such an output signal as shown in FIG. 2E. The inverter 9 selectively inverts the output signal of the sample/hold circuit 8 according to the specific code shown in FIG. 2D, thereby generating such an output signal as shown in FIG. 2C. The output signal of the inverter 9 is delivered from the low-pass filter 10 as a reproduced information signal having such a waveform as illustrated in FIG. 2A.

To reproduce an information signal faithful to an input information signal to the sample/hold circuit 2 of the transmission apparatus 1, it is necessary to operate both sample/hold circuits 2 and 8 in synchronism and also to make synchronous the codes (FIG. 2D) supplied to both inverters 3 and 9.

Figure 3:
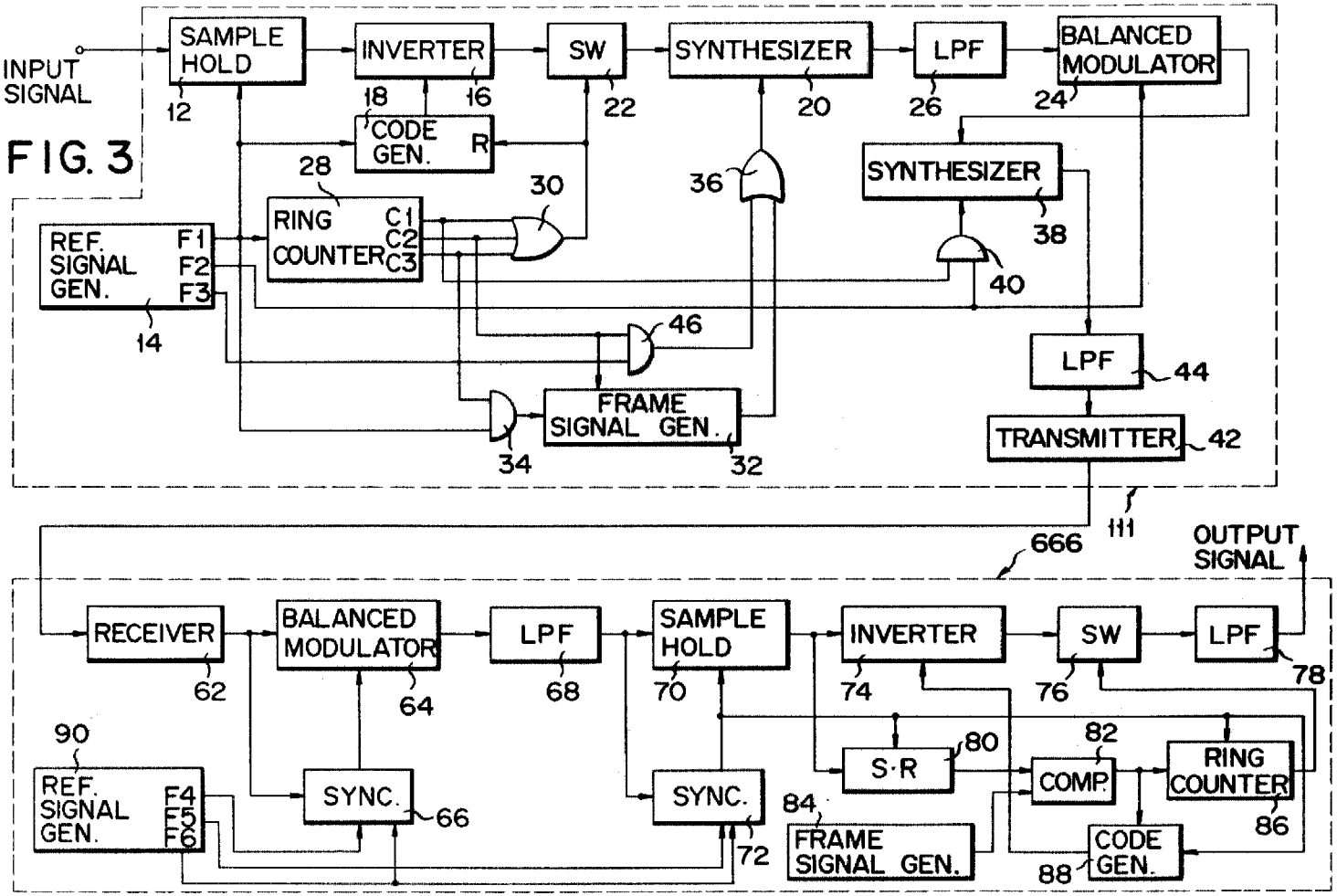
FIG. 3 is a block circuit diagram showing more in detail the security communication system illustrated in FIG. 1.

FIG. 3 shows more in detail the security communication system of FIG. 1, wherein the transmission and reception apparatus operate in synchronism with each other. The system comprises a transmission apparatus 111 and a reception system 666. The transmission system is provided with a sample/hold circuit 12 which samples an input information signal, using pulses having a frequency f1, for example 3.6 KHz, from an output terminal F1 of a reference signal generator 14. The output signal of the sample/hold circuit 12 is supplied to an inverter 16. The inverter 16 inverts the output signal of the sample/hold circuit 12 according to an output signal of a code generator 18, which is driven by a pulse signal having frequency f1 from the reference signal generator 14 to generate such a code as shown in FIG. 2D. The output terminal of the inverter 16 is coupled to a first input terminal of a signal synthesizing circuit 20 through a switch 22. The output terminal of the signal synthesizing circuit 20 is coupled to one input terminal of a balanced modulator 24 via a low-pass filter 26.

The output terminal F1 of the reference signal generator 14 is coupled to a ring counter 28 for counting the output pulse of the generator 14 having frequency f1. While its count changes from 1 to N1 ("30" for example) the ring counter 28 delivers a high level output signal from an output terminal C1. While its count changes from (N1+1) to N2 ("60" for example) the counter 28 delivers a high level output signal from an output terminal C2, and while its count changes from (N2+1) to N3 ("100" for example) the counter 28 delivers a high level output signal from an output terminal C3. The output terminals C1, C2 and C3 of the ring counter 28 are connected via an OR gate 30 to the reset terminal R of the code generator 18 and the control terminal of the switch 22.

The output terminal F1 of the reference signal generator 14 is coupled also to a frame signal generator 32 through an AND gate 34 which is connected at one input terminal to the output terminal C3 of the ring counter 28. The output terminal of the frame signal generator 32 is coupled to a second input terminal of the signal synthesizing circuit 20 through an OR gate 36.

The reference signal generator 14 generates a pulse having a frequency f2, for example 2.5 KHz, from an output terminal F2 which is coupled to a carrier wave input terminal of the balanced modulator 24. The output terminal of the balanced modulator 24 is coupled to a first input terminal of a signal synthesizer 38. The output terminal F2 of the frequency signal generator 14 is coupled also to a second input terminal of the signal synthesizer 38 through an AND gate 40, which is coupled at one input terminal to the output terminal C1 of the ring counter 28. The output terminal of the signal synthesizer 38 is coupled to a transmitter 42 through a low-pass filter 44.

The reference signal generator 14 generates a pulse having a frequency f3, for example 1.8 KHz, from an output terminal F3 which is coupled to the signal synthesizer 20 through an AND gate 46 connected at one input terminal to the output terminal C2 of the ring counter 28 and through the OR gate 36. The pulse having frequency f1, pulse having frequency f2 and pulse having frequency f3 are obtained by, for instance, dividing the frequency of an output signal of a single oscillator (not shown) with different frequency division ratios.

The output signal of the transmission apparatus 111 is supplied to a receiver 62 of the reception apparatus 666. The output terminal of the receiver 62 is coupled to a balanced modulator 64 and a first input terminal of a modulation synchronizing circuit 66, the output terminal of which is coupled to a carrier input terminal of the balanced modulator 64. The output terminal of the balanced modulator 64 is coupled via a low-pass filter 68 to a sample/hold circuit 70 and a first input terminal of a clock synchronizing circuit 72 for supplying a sampling pulse to the sample/hold circuit 70. The output signal of the sample/hold circuit 70 is delivered as a reproduced information signal via an inverter 74, a switch 76 and a low-pass filter 78. It is supplied also to a shift register circuit 80. The output terminal of the shift register circuit 80 is coupled to one input terminal of a comparator 82, the other input terminal of which is coupled to the output terminal of a frame signal generator 84. The shift register circuit 80, comparator 82 and frame signal generator 84 constitute a frame synchronizing circuit. The output terminal of the comparator 82 is coupled to one input terminal of a ring counter 86 which is connected at the output terminal to a control terminal of the switch 76 and also to the reset terminal of a code generator 88 which is connected at the output terminal to a control terminal of the inverter 74. The output signal of the clock synchronizing circuit 72 is supplied as a clock signal to the shift register circuit 80, the ring counter 86 and the code generator 88. The second input terminal of the modulation synchronizing circuit 66 is coupled to an output terminal F4 of a reference signal generator 90 for delivering an output signal having a frequency f4, and the second input terminal of the clock synchronizing circuit 72 is coupled to another output terminal F5 of the generator 90 for delivering an output signal having a frequency f5. The third input terminal of the modulation synchronizing circuit 66 and the third input terminals of the clock synchronizing circuit 72 are coupled to an output terminal F6 of the generator 90 for delivering an output signal having a frequency f6.

With reference to the signal waveforms illustrated in FIGS. 2, 4 and 5, there will be described how the security communication system of FIG. 3 operates.

Figure 4A:
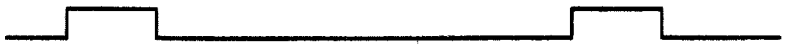
FIGS. 4A–4F show signal waveforms for explaining the operation of the security communication system illustrated in FIG. 3.

The sample/hold circuit 12 samples such an input information signal as shown in FIG. 2A, using sampling signal from the output terminal F1 of the reference signal generator 14 which is shown in FIG. 2B, and produces such an output signal as shown in FIG. 2C. The output signal of the sample/hold circuit 12 is supplied to the inverter 16. The ring counter 28 keeps delivering through the OR gate 30 such an output signal as shown in FIG. 4A so long as its count is less than (N3+1), thereby resetting the code generator 18 to the initial state and opening the switch 22. The ring counter 28 stops generating the output signal after it has counted (N3+1) count and until its count reaches the largest value, for example 4096 count. Thus, the code generator 18 is permitted to generate such a code signal as shown in FIG. 2D and the switch 22 is closed, until the count of the ring counter 28 reaches the largest value. As a result, the first input terminal of the signal synthesizer 20 receives a scrambled information signal with non-signal regions inserted at regular intervals. In other words, the first input terminal of the signal synthesizer 20 receives a signal containing non-signal components which are generated during the high-level periods of the signal shown in FIG. 4A and scrambled information components which are generated during the low-level periods of the signal shown in FIG. 4A.

Figure 4B:
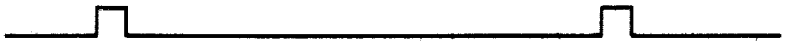
Figure 4C:
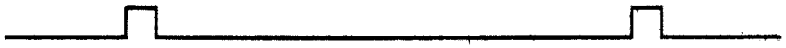
Figure 4D:
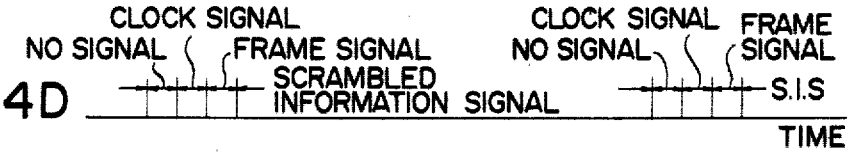
Figure 5A:
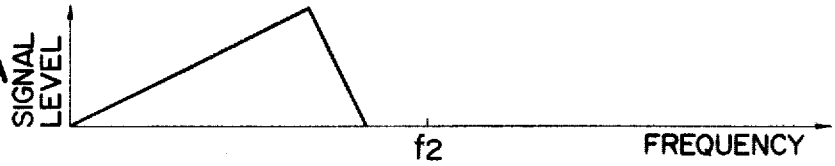
FIGS. 5A–5D show various frequency distributions for explaining the operation of the balanced modulator used in the system illustrated in FIG. 3.
Figure 5B:
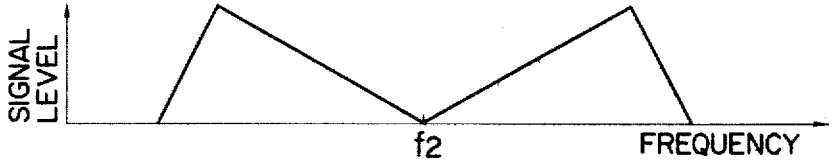

A high level portion of an output signal shown in FIG. 4B, which the counter 28 delivers from the output terminal C2 while its count changes from (N1+1) to N2, enables the AND gate 46 and resets the frame signal generator 32 to the initial state at the same time. While the AND gate 46 is enabled, the pulse from the output terminal F3 of the reference signal generator 14 is supplied as a clock synchronizing signal to the second input terminal of the signal synthesizer 20 through the AND gate 46 and the OR gate 36. A high level portion of an output signal shown in FIG. 4C, which the counter 28 delivers from the output terminal C3 while its count changes from (N2+1) to N3, enables the AND gate 34. While the AND gate 34 is enabled, the pulse from the output terminal F1 of the reference signal generator 14 is supplied to the frame signal generator 32 through the AND gate 34 so as to drive the frame signal generator 32. Thus, while the high level signal as shown in FIG. 4C lasts, the frame signal generator 32 generates a frame synchronizing signal in synchronism with the pulse from the output terminal F1 of the reference signal generator 14. The frame synchronizing signal is supplied to the second input terminal of the signal synthesizer 20 through the OR gate 36. The signal synthesizer 20 combines the input signals supplied to its input terminals to form an output signal having such a signal format as shown in FIG. 4D. The output signal of the signal synthesizer 20 is supplied to the balanced modulator 24 via the low-pass filter 26. The balanced modulator 24 receives the pulse from the output terminal F2 of the reference signal generator 14 as a modulation reference signal, balance-modulates the modulation reference signal according to the input signal from the low-pass filter 26, and converts the frequency spectrum of the input signal. That is, the scrambled information signal having synchronizing signals inserted and having low-frequency signal components as shown in FIG. 5A is used to balance-modulate the modulation reference signal having frequency f2, thereby forming a modulated signal with a frequency spectrum which is, as shown in FIG. 5B, symmetrical with respect to frequency f2.

Figure 4E:
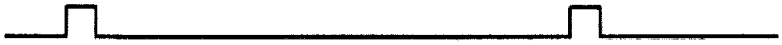
Figure 4F:
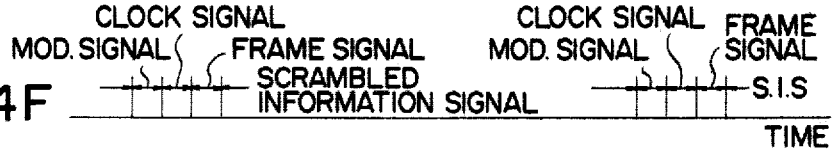
Figure 5C:
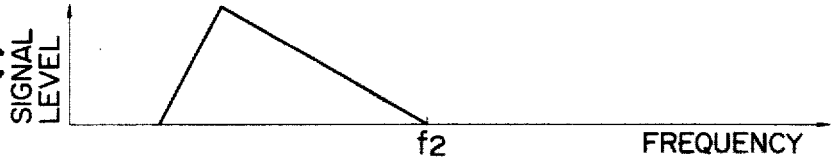

The output signal of the balanced modulator 24 is supplied as a modulation synchronizing signal to the first input terminal of the signal synthesizer 38 which receives at the second input terminal the pulse having frequency f2 from the reference signal generator 14 through the AND gate 40. The AND gate 40 is enabled by a high level signal as shown in FIG. 4E which is delivered from the output terminal C1 of the ring counter 28 while the count thereof changes from 0 to N1. Thus, the pulse having frequency f2 is supplied to the signal synthesizer 38 while the ring counter 28 counts from 0 to N1. The signal synthesizer 38 combines the modulation synchronizing signal and the pulse having frequency f2 to form such an output signal having such a signal format as shown in FIG. 4F. The output signal of the signal synthesizer 38 is supplied to a low-pass filter 44. The low-pass filter 44 filters the output signal of the signal synthesizer 38 to form an output signal having such a frequency spectrum as shown in FIG. 5C. The output signal of the low-pass filter 44 is supplied to the transmitter 42. The transmitter 42 modulates a signal containing such various signal components as shown in FIG. 4F and having such a frequency spectrum as shown in FIG. 5C and then transmits the modulated signal to the reception apparatus 666.

Figure 5D:
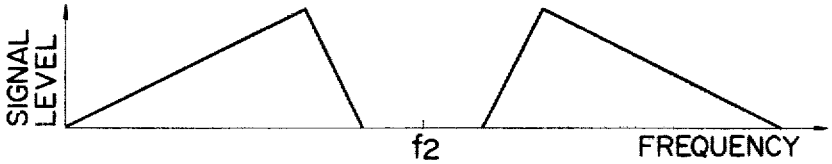

In the reception apparatus 666, the receiver 62 receives an output signal of the transmission apparatus 111 and modulates the same. The output signal of the receiver 62 is supplied to the balanced modulator 64 and the modulation synchronizing circuit 66. The modulation synchronizing circuit 66 examines the phase relationship between the modulation synchronizing signal having frequency f2 and contained in the output signal from the receiver 62 and the synchronizing signal of a high frequency, for example 16×f2, from the output terminal F4 of the reference signal generator 90, so as to supply an output signal having frequency f2 and being synchronous with the detected modulation synchronizing signal, as a modulation reference signal to the balanced modulator 64. The balanced modulator 64 produces an output signal having such a frequency spectrum as shown in FIG. 5D. The output signal of the balanced modulator 64 is supplied via the low-pass filter 68 to the sample/hold circuit 70 and the clock synchronizing circuit 72. Like the modulation synchronizing circuit 66, the clock synchronizing circuit 72 compares the phase of a clock synchronizing signal having frequency f1 from the low-pass filter 68 with the phase of a synchronizing signal from the output terminal F5 of the reference signal generator 90 which has a high frequency of, for example 16×f1, so as to supply an output signal having frequency f1 and synchronous with the detected clock synchronizing signal, to the sampling signal input terminal of the sample/hold circuit 70. The sample/hold circuit 70 produces such an output signal as shown in FIG. 2E. The output signal of the sample/hold circuit 70 is supplied to the inverter 74 and the shift register 80.

Driven by an input signal having frequency f1 from the clock synchronizing circuit 72, the shift register circuit 80 produces an output signal, which is supplied to the first input terminal of the comparator 82. The second input terminal of the comparator 82 receives an output signal of the frame signal generator 84 which is constituted by, for instance, a read only memory and which produces a synchronizing signal similar to the frame synchronizing signal generated by the frame signal generator 32. When the input signals supplied to its first and second input terminals coincide with each other, the comparator 82 produces an output signal to the ring counter 86 and the code generator 88, thereby resetting both the counter 86 and the generator 88 to the initial condition. Once reset, the code generator 88 starts supplying such a code signal as shown in FIG. 2D to the control terminal of the inverter 74. According to the code signal from the code generator 88 the inverter 74 inverts the scrambled information signal supplied immediately after the frame synchronizing signal to form an output signal which is substantially identical with the signal shown in FIG. 2C.

The ring counter 86, now reset by the output signal of the comparator 82, starts a counting operation and produces an output signal while its count changes from "3996" to "4096" (or the largest count). The output signal of the ring counter 86 is supplied to the control terminal of the switch 76 to open the switch 76. Thus, the switch 76 allows the deciphered signal components in the output signal of the inverter 74 to pass and prevents the modulation, clock and frame synchronizing signals from passing. The deciphered signal components are supplied through the switch 76 to the low-pass filter 78, which delivers an information signal substantially identical with the signal shown in FIG. 2A.

The modulation synchronizing circuit 66 is constructed as illustrated in FIG. 6. The circuit 66 is provided with three cascade-connected shift registers 102, 104 and 106 which are driven by output pulses of the output terminal F6 of the generator 90 (FIG. 3), an AND gate 108 with two input terminals coupled to the Q output terminal of the shift register 102 and the $\overline{Q}$ output terminal of the shift register 104, respectively, and an AND gate 110 with two input terminals couplied to the Q output terminal of the shift register 104 and the $\overline{Q}$ output terminal of the shift register 106, respectively. The output terminal of the AND gate 110 is coupled to the reset terminal of a 16-scale ring counter 112 which is driven by output pulses of the output terminal F4 of the reference signal generator 90 (FIG. 3). The output terminal of the ring counter 12 is coupled to a decoder 114. The decoder 114 generates an output pulse when the count of the ring counter 112 is "15," "0" or "1." The output terminal of the decoder 114 is coupled to one input terminal of an AND gate 116 which is connected at the other input terminal to the output terminal of the AND gate 108 and via an inverter to one input terminal of an AND gate 118 which is connected at the other input terminal to the output terminal of the AND gate 108. The output terminal of the AND gate 116 and that of the AND gate 118 are coupled to the clock terminal CK and reset terminal R of a shift register circuit 120, respectively. The shift register circuit 120 is constituted by N cascade-connected shift registers, where "N" denotes an integer. The input terminal D of the first-stage shift register is coupled to a positive power terminal +V, and the output terminal Q of the last-stage shift register is coupled to one input terminal of an AND gate 122 which is connected at the other input terminal to the output terminal of the AND gate 110. The output terminal of the AND gate 122 is coupled to the reset terminal R of a counter 124 which is driven by the output pulses of the reference signal generator 90. The counter 124 generates a high level signal while its count changes from "0" to "7."

With reference to the signal waveforms illustrated in FIG. 7, there will now be described how the modulation synchronizing circuit 66 operates.

Such a modulation synchronizing signal of, for example, 2.5 KHz as shown in FIG. 7A is supplied from the receiver 62 to the shift register 102. Then, the modulation synchronizing signal is then shifted to the shift register 104 and to the shift register 106. The shift registers 102, 104 and 106 are driven by pulses of for example, 640 KHz. As a result, such pulses as shown in FIGS. 7B and 7C are supplied through the AND gates 108 and 110, respectively. An output pulse of the AND gate 110 resets the ring counter 112. The ring counter 112 therefore starts counting a clock pulse from the reference signal generator 90 shown in FIG. 7D. The clock pulse has a frequency of, for example, 40 KHz. Thus, the count of the ring counter 112 changes in such a manner as illustrated in FIG. 7E. When the count of the ring counter 112 is "15," "0" or "1," the decoder 114 generates a high level signal as shown in FIG. 7E. This high level signal enables the AND gate 116 and disables the AND gate 118. As a result, the output pulse of the AND gate 108 is supplied via the AND gate 116 to the clock input terminal CK of the shift register circuit 120 so as to shift the positive input signal supplied to the input terminal D of the circuit 120. When N pulses are successively supplied to the clock terminal of the shift register circuit 120 each time the decoder generates a high level output signal, the shift register circuit 120 generates a high level output signal from its output terminal Q. When enabled by the high level output signal of the shift register circuit 120, the AND gate 122 supplies such an output pulse as shown in FIG. 7C to the reset terminal R of the counter 124, thereby to reset the counter 124. Once reset, the counter 124 starts counting the output pulses of the reference signal generator 90. While its count changes from "0" to "7," the counter 124 supplies a high level signal to the carrier input terminal of the balanced modulator 64.

The AND gate 122 supplies a reset pulse to the counter 124 only when the count of the 16-scale ring counter 112 remains "15," "0" or "1" each time one of successive N pulses is supplied to the AND gate 108. In other words, the counter 124 is reset only when the modulation synchronizing circuit 66 receives an input signal of approximately 2.5 KHz, i.e. a modulation synchronizing signal. When the modulation synchronizing circuit 66 receives any other input signal, i.e. a clock synchronizing signal, a frame synchronizing signal or a scrambled information signal component, the shift register circuit 120 generates a low level signal, which disables the AND gage 122. As a result, no reset pulse is supplied to the counter 124, and the output signal of the counter 124 maintains its phase which has been corrected upon receipt of the modulation synchronizing signal. Thus, if the circuit 66 receives modulation synchronizing signal at such intervals as shown in FIG. 4E, without always receiving a modulation synchronizing signal, the balanced modulator 64 can modulate, using the input signal from the circuit 66, a reference modulation signal which is substantially synchronous with the pulse from the output terminal F2 of the reference signal generator 14 (FIG. 3).

The clock synchronizing circuit 72 is constituted like the modulation synchronizing circuit 66 as illustrated in FIG. 6. Then, it can supply the sample/hold circuit 70 with an output pulse synchronous with the pulse from the output terminal F1 of the reference signal generator 14 in response to an output pulse of 57.6 KHz from the reference signal generator 90. The clock synchronizing signal supplied to the circuit 72 may have a frequency of 3.6 KHz or 1.8 KHz. So long as they do not receive a specific input signal, the synchronizing circuits 66 and 72 generate output pulses with a phase relationship determined by the input signal previously supplied to the synchronizing circuits 66 and 72.

In the above-described security communication system, some parts of an information signal are removed at regular intervals and replaced by synchronizing signals, and the information signal thus scrambled is transmitted from the transmission apparatus 111 to the reception apparatus 666. In this case, the error in a reproduced information signal is negligibly small only if the synchronizing signal period is far shorter than the information signal period.

An information signal of 1.5 KHz was sampled by sampling pulses of 3.6 KHz and scrambled. Then, a part of the scrambled information signal was removed for 3 miliseconds every 1.12 seconds and was replaced by a synchronizing signal. The scrambled information signal was then modulated with a reference modulation signal of 2.5 KHz. The modulated information signal was transmitted from the transmission apparatus 111 to the reception apparatus 666. Then, the low-pass filter 78 delivered a reproduced information signal. This reproduced information signal was found substantially not to be affected by removal of some parts of the original information signal. Further, an audio signal of 1.5 KHz was scrambled, modulated and transmitted in the same manner as was the information signal. Then, the sound reproduced of the scrambled audio signal was extremely clear, and the message could be well understood. When the scrambled audio signal was monitored by a commercially available receiver, the message could not be understood at all. Further, the frequency of a signal from the transmission apparatus 111 could be set from 300 Hz to 3 kHz when the frequency of the reference modulation signal was changed to various values.

This invention is not limited to the above-described embodiment. Other embodiments are possible within the technical scope of this invention. For example, the transmitter 42 may be so constituted as to modulate an input signal from the low-pass filter 44 to form a radio wave and may be provided with an antenna for transmitting the radio wave to the reception apparatus 666.

Further, the reference modulation signal supplied to the balanced modulator 24 may have frequency f1, instead of frequency f2. Then, the security communication system can be made a little more simple. More precisely, modulation synchronization becomes possible without inserting modulation synchronizing signals into an information signal by means of the signal synthesizer 38, only if the modulation synchronizing circuit 66 is so modified as to shift the phase of the reference modulation signal.

In the above-described embodiment the inverter 16 scrambles an input signal according to a specific code from the code generator 18. Instead, any other scrambling device than the inverter 16 may be employed for the same purpose. Further, the inverters 16 and 74 may be so designed as to stop working upon receipt of an input signal which the code generators 18 and 88 generate when they are reset, thereby to omit the switches 22 and 76.

The experiments with the above-described security communication system showed that the error in a reproduced information signal became too large to neglect when the ratio of the synchronizing signal period to the information signal period was 1/20 or more. In view of this, it would be preferred that said ratio should be about 1/30 or less.

Figure 8:
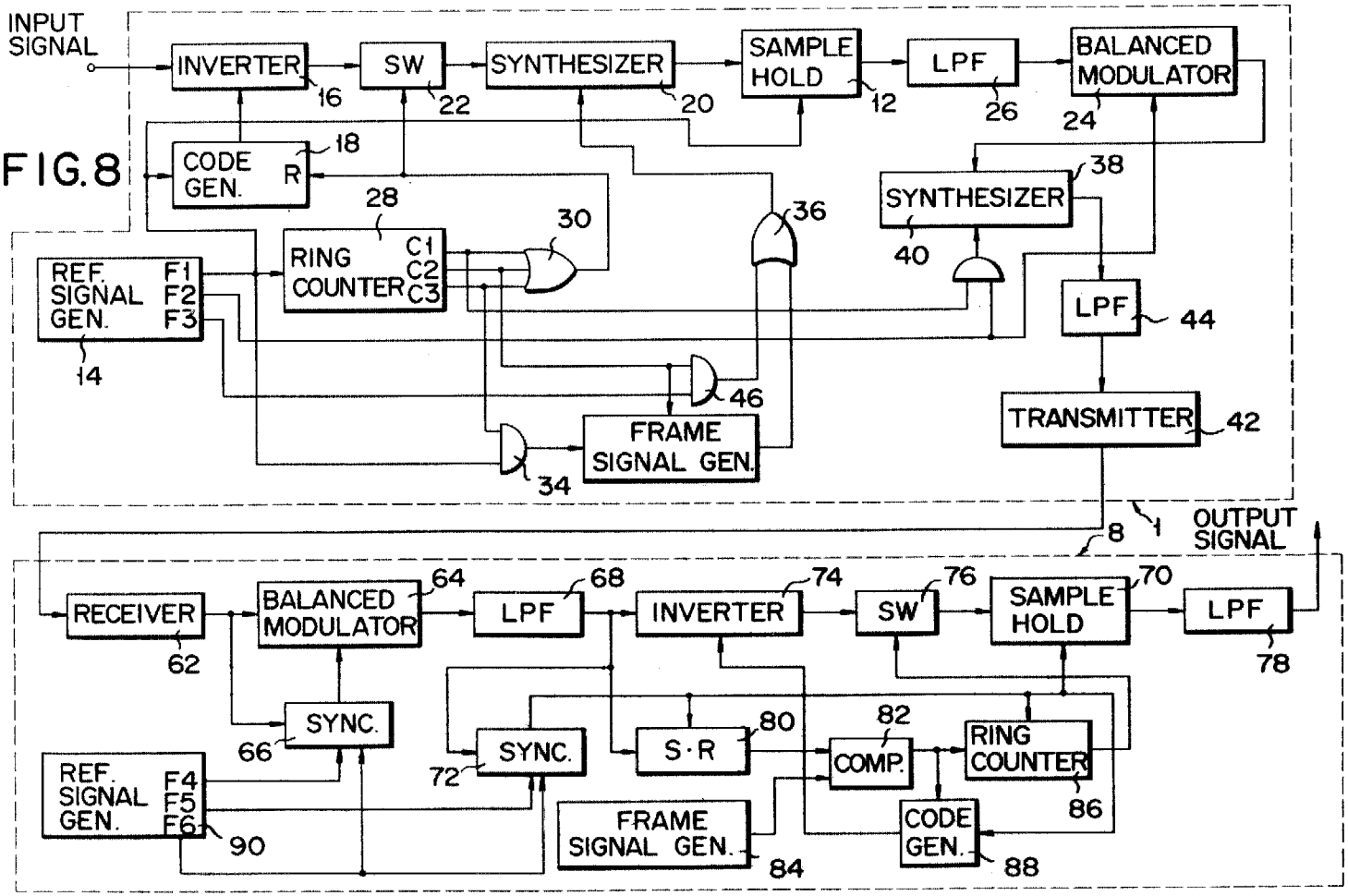
FIG. 8 illustrates a modification of the security communication system shown in FIG. 3.

In the above-described embodiment an information signal is sampled and then selectively inverted according to a specific code. Instead, an information signal may be selectively inverted according to a specific code and then sampled to obtain the same effects, if the system is modified as illustrated in FIG. 8. The security communication system shown in FIG. 8 comprises a transmission apparatus 111 and a reception apparatus 666, too. The transmission apparatus 111 differs from the transmission apparatus 111 of the embodiment shown in FIG. 3 in that an information signal is selectively inverted by an inverter 16 according to a specific code from a code generator 18 and is then sampled by a sample/hold circuit 12. The reception apparatus 666 differs from that of the embodiment shown in FIG. 3 in that a signal from a balanced modulator 64 via a low-pass filter 68 is selectively inverted by an inverter 74 according to a specific code from a code generator 88 and is then sampled by a sample/hold circuit 70. Except for these points, the system of FIG. 8 is identical with the system shown in FIG. 3. In both embodiments, the same input information is supplied to the balanced modulator 24 through the low-pass filter 26, and the same reproduced information signal is delivered from the low-pass filter 78.

In the security communication system illustrated in FIG. 3 it is possible to connect the sample/hold circuit 12 in the stage following the inverter 16 or the switch 22 and connect the sample/hold circuit 70 in the stage following the inverter 74 or the switch 76.

What we claim is:

1. A security communication system comprising:

a transmission apparatus including a first signal generating circuit for generating a synchronizing signal, a scrambling circuit for scrambling an input information signal according to a specific code to form a scrambled information signal and for making invalid the scrambled information signal during generation of the synchronizing signal from the first signal generating circuit to insert non-signal regions into the scrambled information signals, and a signal synthesizing circuit coupled to the first signal generating circuit and the scrambling circuit for inserting the synchronizing signal from the first signal generating circuit into the non-signal regions of the scrambled information signal;

a reception apparatus including a deciphering circuit for deciphering the scrambled information signal from the transmission apparatus according to a code substantially the same as said specific code, and a second signal generating circuit for detecting the synchronizing signal contained in the scrambled information signal and supplying the deciphering circuit with an output signal synchronous with the synchronizing signal to control the timing for start of a deciphering operation in the deciphering circuit;

wherein said scrambling circuit has a first code generating circuit for generating said specific code in response to a synchronizing signal from said first signal generating circuit, a first inverter circuit for selectively inverting an input information signal according to the specific code from the first code generating circuit, a switching circuit which is triggered in response to a synchronizing signal from said first signal generating circuit to provide said non-signal regions in the scrambled information signal thereby preventing an output signal of said first inverter circuit from being supplied to said first signal generating circuit and a sample/hold circuit connected in series to said first inverter circuit; and wherein said first signal generating circuit has a reference signal generating circuit for supplying sampling signal to said sample/hold circuit, a first counter circuit coupled to the reference signal generating circuit for counting output signal thereof and for generating an output signal when it has count between a first predetermined count and a second predetermined count, to trigger said switching circuit, and a first synchronizing signal generator for serially generating modulation synchronizing signal, sampling clock synchronizing signal and frame synchronizing signal in response to an output signal of the first counter circuit for the duration of the output signal thereof; and said transmission apparatus further includes a balanced modulator for balance-modulating an output signal of said first signal synthesizing circuit, a second signal synthesizing circuit with one input terminal coupled to said balanced modulator, means for supplying said first signal synthesizing circuit with the sampling clock synchronizing signal and frame synchronizing signal from the first synchronizing signal generator, and means for supplying the moduation synchronizing signal from the first synchronizing signal generator to the second input terminal of the second signal synthesizing circuit.

2. A security communication system according to claim 1, wherein said reception apparatus has a modulation synchronizing signal generator for generating an output signal upon detection of a modulation synchronizing signal in the scrambled information signal from said transmission apparatus and a balanced modulator for balance-modulating the scrambled information signal from said transmission apparatus in response to an output of said modulation synchronizing signal generator to supply a modulated output signal to said deciphering circuit.

3. A security communication system according to claim 2, wherein said deciphering circuit has a second code generating circuit for generating a specific code substantially the same as the specific code generated by said first code generating circuit, and a second inverter circuit for selectively inverting an input information signal according to the specific code from the second code generating circuit.

4. A security communication system according to claim 3, wherein said deciphering circuit further includes a frame synchronizing signal generator for generating an output signal upon detection of a frame synchronizing signal in a scrambled information signal from said transmission apparatus, to trigger said second code generating circuit.

5. A security communication system according to claim 4, wherein said deciphering circuit further includes a sample/hold circuit coupled in series to said second inverter circuit, and said second signal generating circuit has a clock synchronizing signal generator for supplying the sample/hold circuit with sampling clock signal which is synchronous with the sampling clock signal from said transmission apparatus.

6. a security communication system according to claim 4 or 5, wherein said deciphering circuit further includes a second counter circuit for generating an output signal in response to an output signal of said frame synchronizing signal generator when it has a count between a third predetermined count and a fourth predetermined count, and a switching circuit which is coupled to the output terminal of said second inverter circuit and which is opened in response to an output signal of the second counter circuit.

* * * * *